US011473591B2

(12) United States Patent
Wang et al.

(10) Patent No.: US 11,473,591 B2
(45) Date of Patent: Oct. 18, 2022

(54) FAN BLADE UNIT AND FAN IMPELLER STRUCTURE THEREOF

(71) Applicant: ASIA VITAL COMPONENTS (CHINA) CO., LTD., Shenzhen (CN)

(72) Inventors: Chung-Shu Wang, Shenzhen (CN); Yu-Tzu Chen, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 137 days.

(21) Appl. No.: 16/161,023

(22) Filed: Oct. 15, 2018

(65) Prior Publication Data

US 2020/0116160 A1 Apr. 16, 2020

(51) Int. Cl.

| | |
|---|---|
| ***F04D 29/38*** | (2006.01) |
| ***F04D 29/66*** | (2006.01) |
| ***F04D 19/00*** | (2006.01) |

(52) U.S. Cl.

CPC ..... *F04D 29/388* (2013.01); *F04D 19/002* (2013.01); *F04D 29/663* (2013.01); *F04D 29/668* (2013.01)

(58) Field of Classification Search

CPC ..... F04D 29/388; F04D 29/66; F04D 29/661; F04D 29/663; F04D 29/666; F04D 29/667; F04D 29/668; F04D 29/68; F04D 29/681; F04D 19/002

See application file for complete search history.

(56) References Cited

U.S. PATENT DOCUMENTS 1,317,707 A * 10/1919 Johnson ..... F01D 5/20 416/228
1,955,929 A * 4/1934 Mueller ..... F01D 5/20 415/173.1
1,970,435 A * 8/1934 Sharp ..... F03B 3/06 73/455

(Continued)

FOREIGN PATENT DOCUMENTS

CN 112128138 A * 12/2020
JP 2006214371 A 8/2006

(Continued)

OTHER PUBLICATIONS

Search Report dated May 30, 2019 issued by Taiwan Intellectual Property Office for counterpart application No. 107134129.

*Primary Examiner* — David E Sosnowski
*Assistant Examiner* — Wayne A Lambert
(74) *Attorney, Agent, or Firm* — Bradley J. Thorson; DeWitt LLP

(57) ABSTRACT

A fan blade unit and a fan impeller structure thereof. The fan blade unit includes a main body having a root section and an end section. The root section is connected with a hub. The end section extends in a radial direction away from the hub. The end section defines a first direction and a second direction. Multiple protrusion bodies are disposed at the end section and at least one channel is formed between the protrusion bodies. The channel extends in the first direction. The fan blade unit is applied to the fan impeller structure. When the fan impeller rotates, a high-pressure area is created between the channel and the wall of the outer frame of the fan, whereby the airflow is restrained from turning over from the lower wing face to the upper wing face to generate wingtip vortex.

18 Claims, 10 Drawing Sheets

(56) References Cited

U.S. PATENT DOCUMENTS 2,014,032 A * 9/1935 Sharpe ..... F04D 29/384 416/228
2,045,918 A * 6/1936 Moody ..... F03B 3/06 415/221
2,457,325 A * 12/1948 Sidell ..... F04D 29/34 416/222
2,463,340 A * 3/1949 Wiberg ..... F01D 5/18 416/232
3,044,559 A * 7/1962 Chajmik ..... B63H 1/28 416/228
4,097,192 A * 6/1978 Kulina ..... F01D 5/14 416/175
4,390,320 A * 6/1983 Eiswerth ..... F01D 5/005 29/889.1
4,892,460 A * 1/1990 Volk ..... F04D 25/088 416/62
4,913,670 A * 4/1990 Spranger ..... B64C 11/18 440/49
5,513,951 A * 5/1996 Komoda ..... F04D 29/386 415/119
5,564,901 A * 10/1996 Moore ..... F04D 29/384 415/220
5,951,162 A * 9/1999 Weetman ..... B01F 7/001 366/328.1
5,992,793 A * 11/1999 Perry ..... B64C 27/463 244/17.11
6,168,383 B1 * 1/2001 Shimizu ..... B64C 27/463 415/119
6,206,642 B1 * 3/2001 Matheny ..... F01D 5/147 415/173.5
6,334,705 B1 * 1/2002 Weetman ..... B01F 3/04531 366/330.1
6,761,539 B2 * 7/2004 Cipelletti ..... F04D 29/164 416/228
7,033,131 B2 * 4/2006 Schreiber ..... F01D 5/16 415/12
8,550,782 B2 * 10/2013 Hoskins ..... F04D 29/384 416/191
9,121,444 B2 * 9/2015 Yuan ..... F16C 35/02
9,303,651 B2 * 4/2016 Yuan ..... F04D 29/056
9,726,190 B2 * 8/2017 Kumon ..... F04D 25/08
9,726,192 B2 * 8/2017 Whitley ..... F04D 29/388
10,132,331 B2 * 11/2018 Mokulys ..... F04D 17/10
2003/0021089 A1 * 1/2003 Belady ..... F04D 29/38 361/695
2003/0095864 A1 * 5/2003 Ivanovic ..... F04D 29/384 415/119
2004/0062654 A1 * 4/2004 Chang ..... F04D 29/327 416/223 R
2006/0067821 A1 * 3/2006 Wadia ..... F04D 29/682 416/97 R
2006/0099071 A1 * 5/2006 Kao ..... F04D 29/667 415/206
2007/0098562 A1 * 5/2007 Tudor ..... F01D 5/20 416/236 R
2007/0160459 A1 * 7/2007 Tudor ..... F04D 29/526 415/119
2007/0160468 A1 * 7/2007 Tsubota ..... F01P 5/06 415/173.6
2011/0182737 A1 * 7/2011 Zha ..... F04D 29/164 416/193 R
2015/0071786 A1 * 3/2015 Kumon ..... F04D 29/384 416/223 R
2017/0184129 A1 * 6/2017 He ..... F04D 29/281
2018/0066521 A1 * 3/2018 Sawada ..... F04D 29/384
2018/0135645 A1 * 5/2018 Chen ..... F04D 29/384
2018/0306207 A1 * 10/2018 Chang ..... F04D 29/663
2019/0048889 A1 * 2/2019 Roberge ..... F01D 5/147
2019/0072112 A1 * 3/2019 Lin ..... F04D 29/667

FOREIGN PATENT DOCUMENTS

TW I596281 8/2017
TW M575063 3/2019

* cited by examiner

FAN BLADE UNIT AND FAN IMPELLER STRUCTURE THEREOF

BACKGROUND OF THE INVENTION

1. Field of the Invention

The present invention relates generally to the field of cooling fan, and more particularly to a fan blade structure of a cooling fan and a fan impeller structure with the fan blade structure.

2. Description of the Related Art

In a conventional axial-flow fan, the pressures on the upper wing face and the lower wing face of the tip of the fan blade are not uniformly distributed. As a result, the airflow will turn over from the high-pressure lower wing face to the low-pressure upper wing face to generate strong wingtip vortex at the wingtip section. The wingtip vortex will lead to unstable flow field of the fan to increase the noise and deteriorate the performance of the fan.

In order to weaken the strength of the wingtip vortex, in the conventional manner, the blade area of outer edges of the wingtip 90 is increased and the wingtip is designed with small wings 91 (as shown in FIG. 1A). Alternatively, a loop structure 92 is added to the wingtip to extend toward the wing root (as shown in FIG. 1B). All these added structures mainly serve to prevent the fluid of the lower wing face from turning over to the upper wing face so as to weaken the strength of wingtip vortex. However, the above manner leads to some other problems. In FIG. 1A, the small wings 91 of the wingtip change the original geometrical configuration of the wingtip of the fan blade. As a result, the path in which the fluid flows through the wingtip is interrupted or bent to deteriorate the performance of the fan. In FIG. 1B, the loop structure 92 is added to the upper side of the wingtip. This leads to increase of the weight load of the wingtip and makes the structure unstable as well as enlarges the vibration at the end point. When the fan blade rotates by high speed and at high temperature, the fan blade is at the risk of deformation.

It is therefore tried by the applicant to provide a fan blade unit and a fan impeller structure thereof to solve the above problems existing in the conventional fan.

SUMMARY OF THE INVENTION

It is therefore a primary object of the present invention to provide a fan blade unit and a fan impeller structure of an axial-flow fan. Each fan blade unit has an end section having multiple protrusion bodies defining therebetween a channel. When the fan blade unit rotates, the channel creates a high-pressure area to restrain the generation of wingtip vortex.

It is a further object of the present invention to provide the above fan blade unit and the fan impeller structure thereof, which can reduce the pressure loss caused by the wingtip vortex so as to enhance the working performance of the fan.

It is still a further object of the present invention to provide the above fan blade unit and the fan impeller structure thereof, which can reduce the interaction between the wingtip vortex and the wall of the outer frame of the fan so as to reduce the vibration of the end section of the fan blade.

To achieve the above and other objects, the fan blade unit of the present invention includes a main body having a root section and an end section. The root section is connected with a hub. The end section extends in a radial direction away from the hub. The end section defines a first direction and a second direction. Multiple protrusion bodies are disposed at the end section and at least one channel is formed between the protrusion bodies. The channel extends in the first direction.

Still to achieve the above and other objects, the fan impeller structure of the present invention includes a hub and multiple fan blade units. Each fan blade unit includes a main body having a root section, an end section, multiple protrusion bodies and at least one channel. The root section is connected with an outer circumference of the hub. The end section extends in a radial direction away from the hub. The end section defines a first direction and a second direction. The protrusion bodies are disposed at the end section. The channel is formed between the protrusion bodies. The channel extends in the first direction.

By means of the above structure, when the fan blade is rotated, the channel at the end section of the fan blade creates a high-pressure area to restrain the generation of the wingtip vortex so as to avoid various ill affection on the fan and further lower the noise, enhance the performance of the fan and reduce the vibration of the end section of the fan blade.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
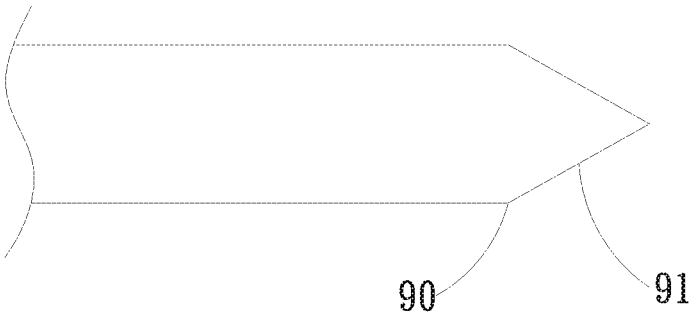
(PRIOR ART) Fig. 1A
FIG. 1A is a schematic diagram of a conventional fan blade.
Figure 1B:
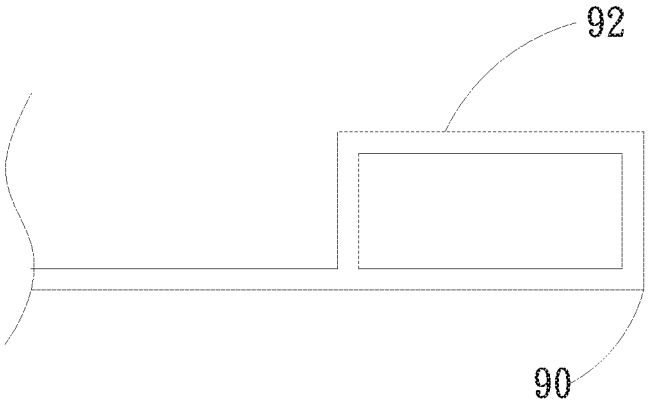
(PRIOR ART) Fig. 1B
FIG. 1B is a schematic diagram of another conventional fan blade.
Figure 2A:
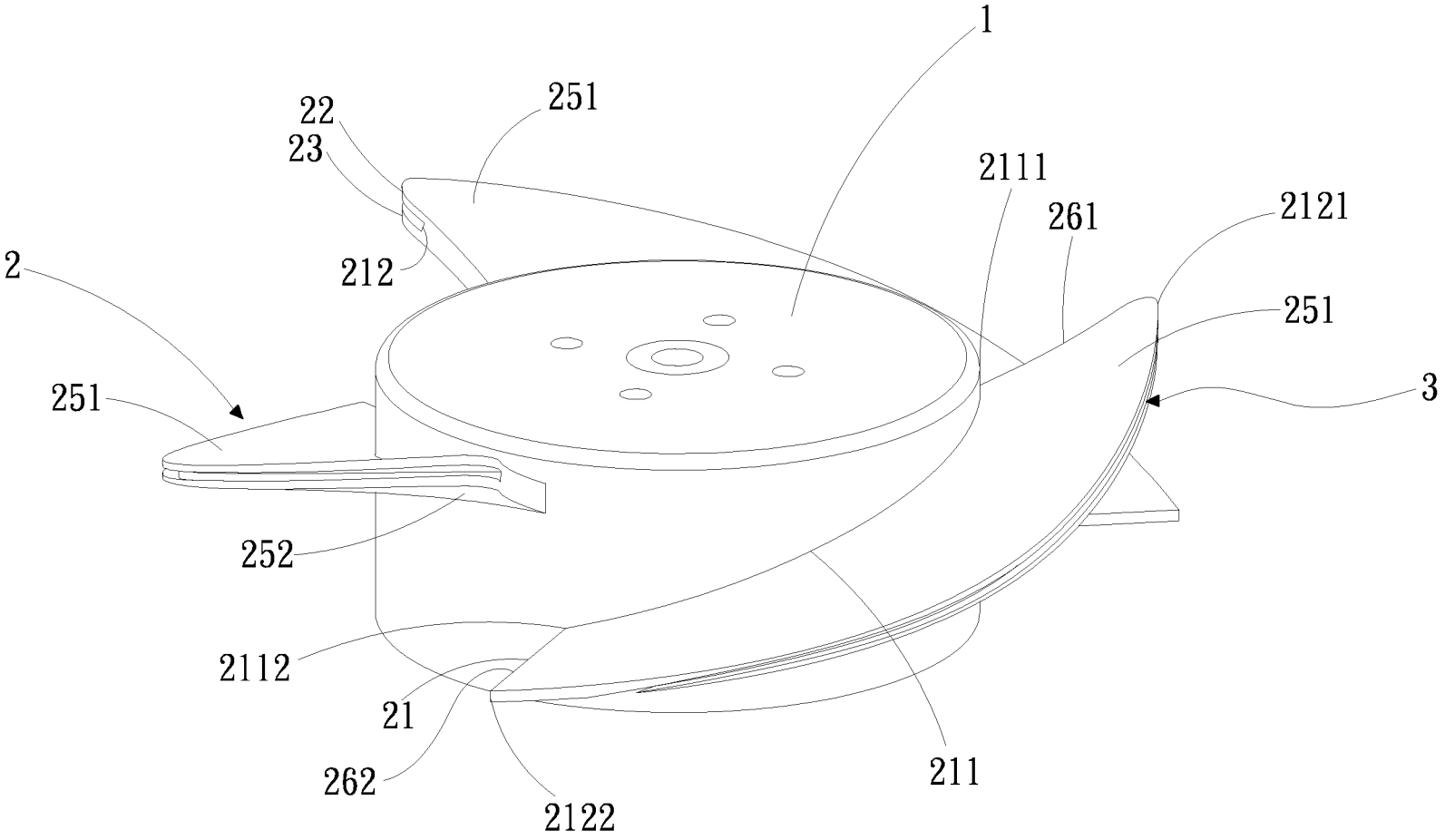
FIG. 2A is a perspective view of the fan impeller structure of the present invention.
Figure 2B:
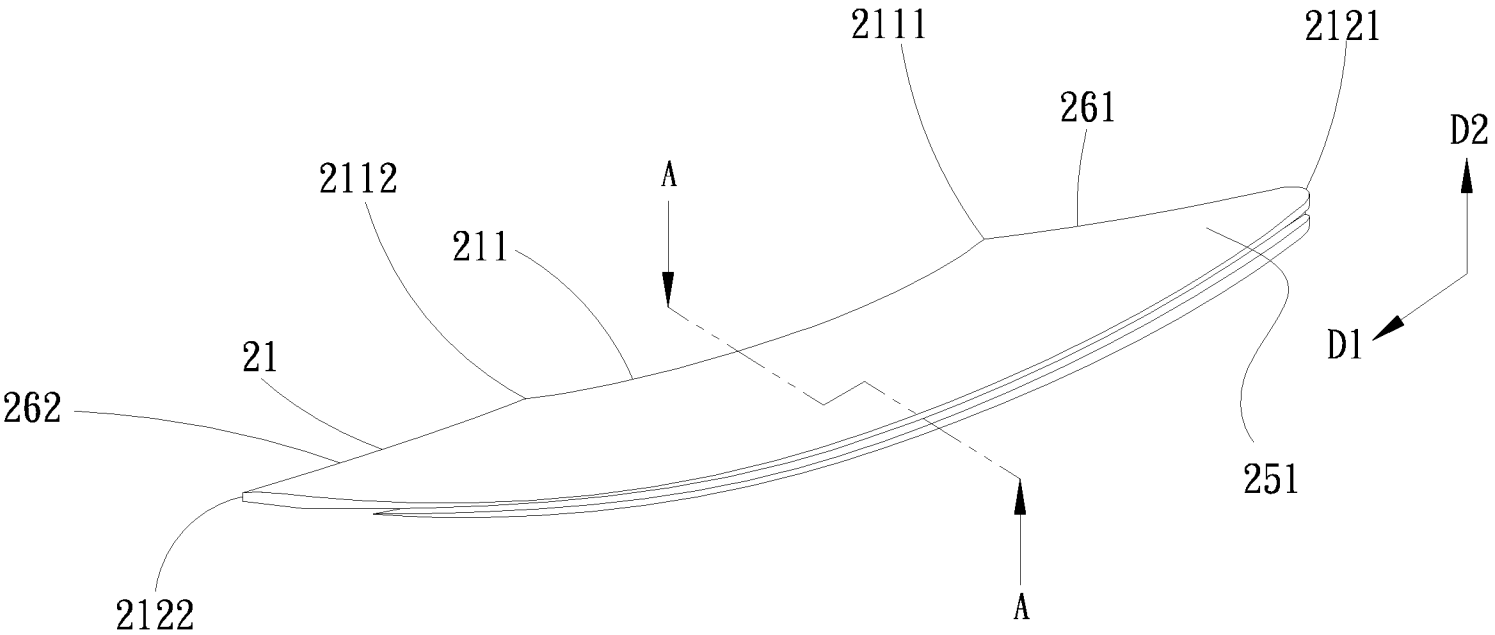
FIG. 2B is a perspective view of the fan impeller structure of the present invention.
Figure 2C:
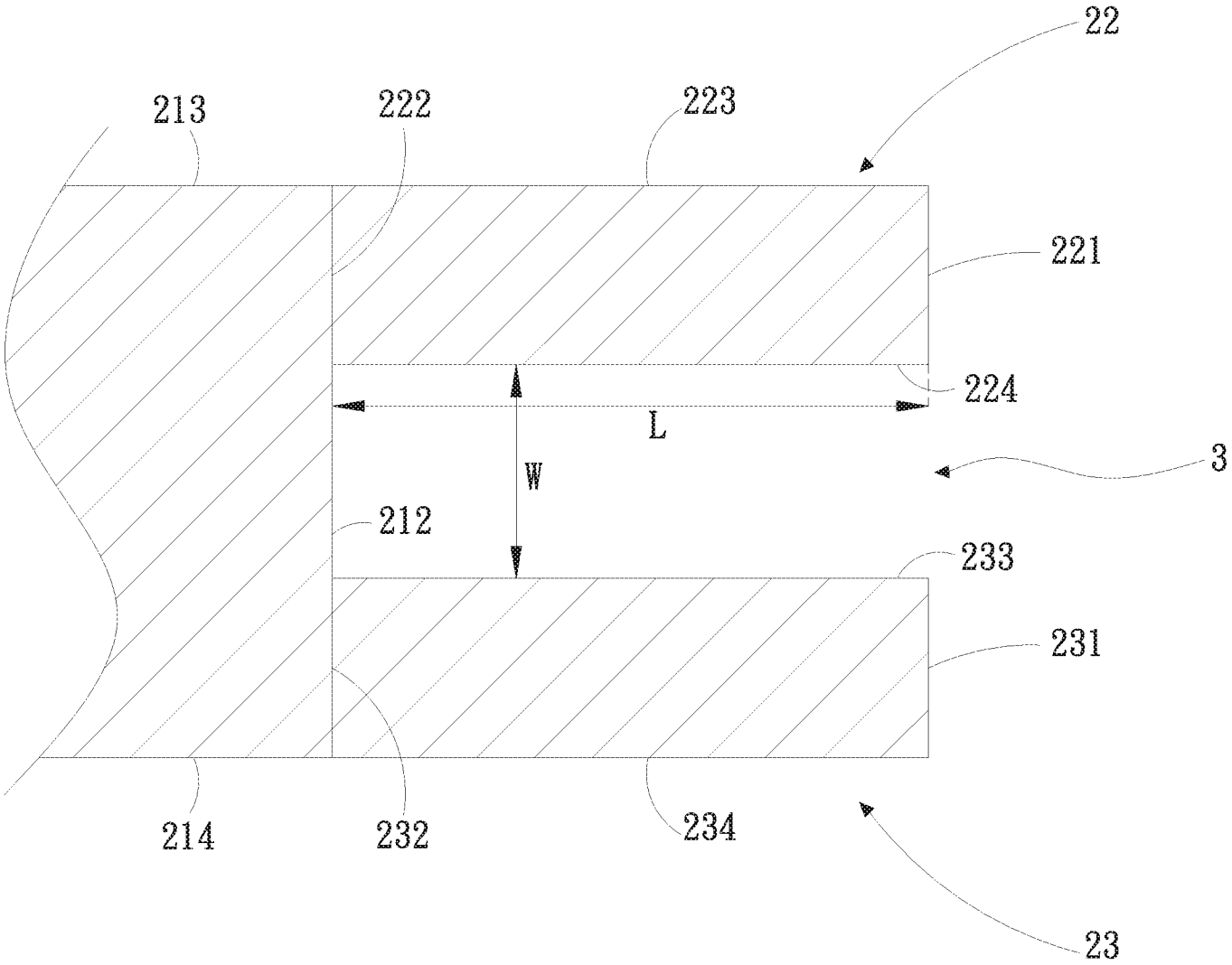
FIG. 2C is a sectional view of the end section of the fan blade of the present invention.
Figure 2D:
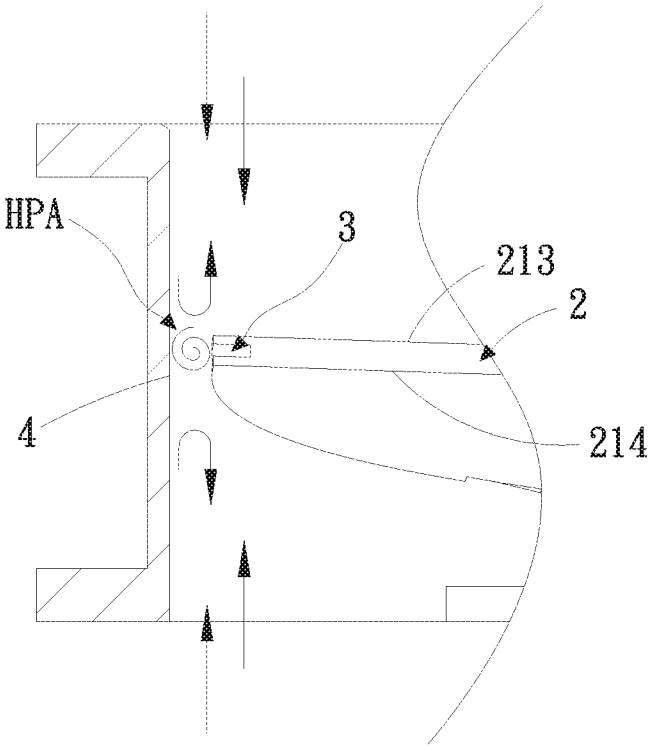
FIG. 2D is a view showing the direction of the airflow when the fan blade of the present invention is rotated to generate the high-pressure area.

Please refer to FIGS. 2A, 2B and 2C. The present invention mainly includes a hub 1 and multiple fan blade units 2. The fan blade units 2 are disposed on an outer circumferential surface of the hub 1. Each fan blade unit 2 has a main body 21. The main body 21 has a root section 211, an end section 212, an upper surface 213, a lower surface 214, a windward side 251, a leeward side 252, a leading edge section 261 and a trailing edge section 262. The root section 211 and the end section 212 are respectively positioned at two opposite ends of the main body 21. The root section 211 has a first end 2111 and a second end 2112 and is connected with the outer circumferential surface of the hub 1. The end section 212 has a third end 2121 and a fourth end 2122 and extends in a radial direction away from the hub 1. The leading edge section 261 is defined between the first end 2111 and the third end 2121, and the trailing edge section 262 is defined between the second end 2112 and the fourth end 2122.

The end section 212 of the fan blade unit 2 defines a first direction D1 and a second direction D2. The first and second directions D1, D2 are normal to each other. The first direction D1 is a lengthwise side of the end section 212, while the second direction D2 is a widthwise side of the end section 212. The first direction D1 is a direction extending from the leading edge section 261 to the trailing edge section 262, and the second direction D2 is a direction from the windward side 251 to the leeward side 252. The end section 212 is formed with multiple protrusion bodies defined as a first protrusion body 22 and a second protrusion body 23. The first and second protrusion bodies 22, 23 are disposed in the first direction D1. The first and second protrusion bodies 22, 23 and the end section 212 form a channel 3.

The first protrusion body 22 has a first top face 221, a first bottom face 222, a first left face 223 and a first right face 224. The second protrusion body 23 has a second top face 231, a second bottom face 232, a second left face 233 and a second right face 234. The first and second bottom faces 222, 232 are connected with the end section 212. Moreover, the first and second protrusion bodies 22, 23 and the end section 212 can be integrally formed or first respectively formed as separate members and then assembled with each other. In the case that the first and second protrusion bodies 22, 23 and the end section 212 are integrally formed, the first and second protrusion bodies 22, 23 can be manufactured by means of filling, material removing, plastic injection or slider process. In the case that the first and second protrusion bodies 22, 23 and the end section 212 are first respectively formed as separate members and then assembled with each other, the first and second protrusion bodies 22, 23 and the end section 212 can be connected with each other by means of insertion, riveting, latching, adhesion, locking, welding or fusion.

The channel 3 has a length L and a width W. The length L is determined by the lengths of the first and second protrusion bodies 22, 23, while the width W is determined by the thickness of the first and second protrusion bodies 22, 23. That is, the length L and width W of the channel 3 can be adjusted by means of controlling the lengths and thickness of the first and second protrusion bodies 22, 23. The channel 3 is open at the leading edge section 261 and has one end connected with the leading edge section 261.

Please refer to FIGS. 2A, 2B, 2C and 2D. When the hub 1 is rotated, the fan blade units 2 are driven to rotate at high speed. At this time, the interior of the channel 3 serves as a fluid dead area and the fluid generates a micro-vortex in the channel 3, whereby a high-pressure area HPA is created between the channel 3 and the wall 4 of the outer frame of the fan. Under such circumstance, the airflow on lower side (the air under the lower surface 214) cannot pass through the gap between the fan blade unit 2 and the wall 4 of the outer frame of the fan to interact with the airflow on upper side (the air above the upper surface 213) to generate wingtip vortex. Therefore, the noise made by the wingtip vortex can be avoided to reduce the vibration of the end section and enhance the performance of the fan.

It should be especially noted that the length L and width W of the channel 3 will affect the size of the high-pressure area HPA. The larger the length L is, the greater the strength of the generated high-pressure area HPA is. The larger the width W is, the larger the range of the generated high-pressure area HPA is. Therefore, the optimal length L and width W can be determined according to the working point of the fan in working.

Please now refer to FIGS. 3A, 3B, 3C, 3D, 3E, 3F, 3G and 3H. Also referring to FIGS. 2A to 2D, there are various fan blade units 2 with different aspects. These modified embodiments have the same technical features of double protrusion bodies and one single channel structure. FIGS. 3A to 3D are side views of the fan blade units 2 for illustration. FIGS. 3E to 3H are top views of the end sections 212 of the fan blade units 2 for illustration.

Figure 3A:
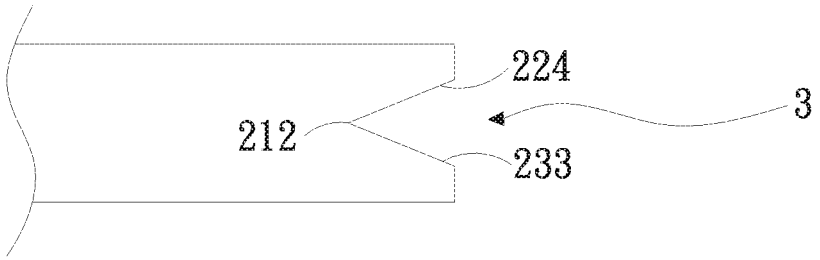
FIG. 3A is a schematic diagram of a first modified embodiment of the fan blade of the present invention with one single channel structure.

In FIG. 3A, the first right face 224 and the second left face 233 are inclined, whereby the channel 3 has a triangular form. This helps in speeding the generation of the high-pressure area HPA. Alternatively, the channel 3 can have a circular form, elliptic form, parallelogram form, trapezoidal form, regular polygonal form or asymmetric form.

Figure 3B:
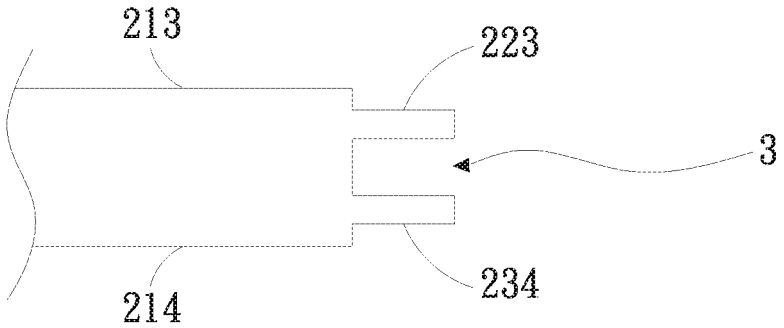
FIG. 3B is a schematic diagram of a second modified embodiment of the fan blade of the present invention with one single channel structure.

In FIG. 3B, a height difference (discontinuous plane) exists between the first left face 223 and the upper surface 213 and a height difference (discontinuous plane) exists between the second right face 234 and the lower surface 214. These height differences provide airflow guiding effect, whereby the airflow on the lower side of the fan blade unit 2 is harder to get close to the high-pressure area HPA generated by the channel 3. In this case, the restrain of generation of the wingtip vortex is more enhanced.

Figure 3C:
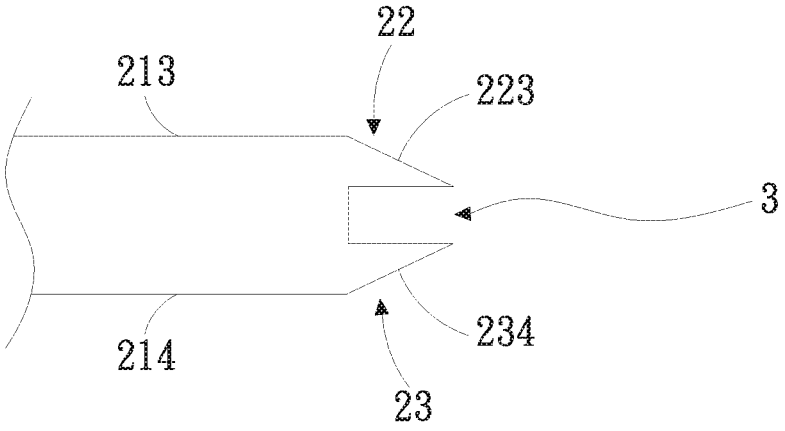
FIG. 3C is a schematic diagram of a third modified embodiment of the fan blade of the present invention with one single channel structure.

In FIG. 3C, the first left face 223 and the second right face 234 are inclined. The upper surface 213 and the first left face 223 are continuous but unparallel planes. Also, the lower surface 214 and the second right face 234 are continuous but unparallel planes. Such configurations of the first and second protrusion bodies 22, 23 provide airflow stopping effect, whereby the airflow on the lower side of the fan blade unit 2 is harder to get close to the high-pressure area HPA generated by the channel 3. In this case, the restrain of generation of the wingtip vortex is more enhanced.

Figure 3D:
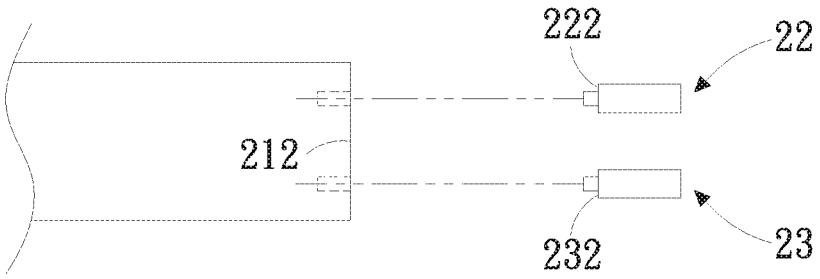
FIG. 3D is a schematic diagram of a fourth modified embodiment of the fan blade of the present invention with one single channel structure.

In FIG. 3D, the end section 212 has multiple receiving sections. The first bottom face 222 of the first protrusion body 22 has an assembling section and the second bottom face 232 of the second protrusion body 23 has an assembling section. The width W of the channel 3 can be adjusted by way of assembling and the configuration of the channel 3 can be changed by means of replacing the first and second protrusion bodies 22, 23 with otherwise shaped first and second protrusion bodies 22, 23 or the height difference as shown in FIG. 3B can be achieved so as to quickly change the configuration of the channel 3.

The aforesaid technical features can be freely co-used. For example, the features of FIGS. 3A and 3C can be combined, whereby the first and second protrusion bodies 22, 23 have a triangular form so as to more quickly generate the high-pressure area HPA and provide the airflow stopping effect. Alternatively, the features of FIGS. 3B and 3C can be combined so as to more quickly generate the high-pressure area HPA and provide the airflow guiding effect.

Figure 3E:
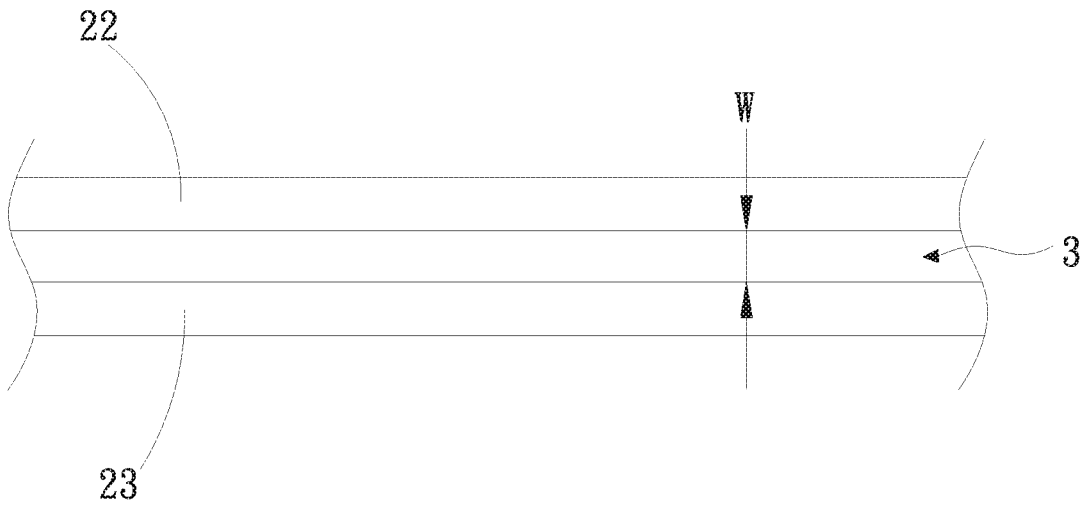
FIG. 3E is a schematic diagram of a fifth modified embodiment of the fan blade of the present invention with one single channel structure.

In FIG. 3E, the first and second protrusion bodies 22, 23 are arranged at equal interval in parallel to each other, whereby the width W of the channel 3 is unified in every position and the channel 3 is positioned in the middle. By means of such arrangement, the high-pressure area HPA can be stably generated everywhere of the fan blade unit 2.

Figure 3F:
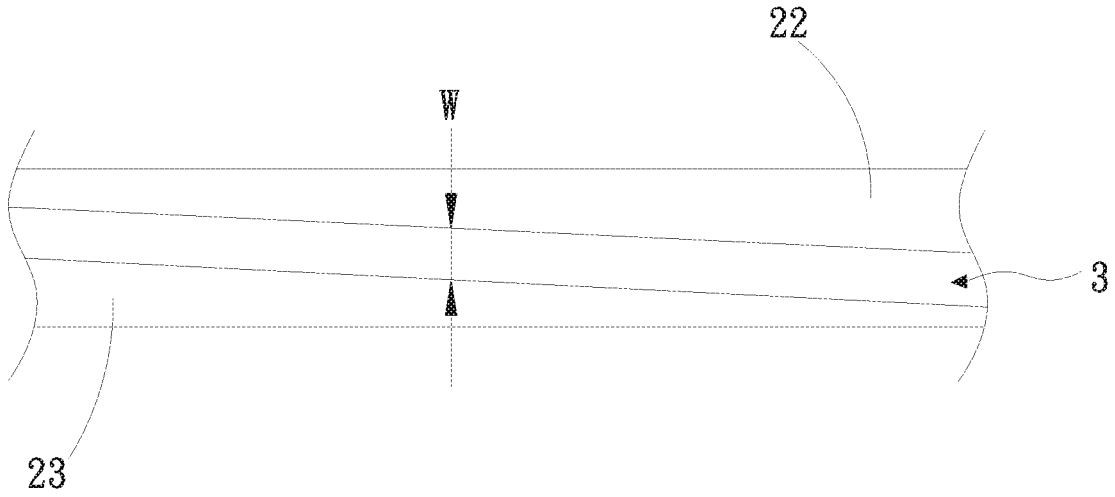
FIG. 3F is a schematic diagram of a sixth modified embodiment of the fan blade of the present invention with one single channel structure.

In FIG. 3F, the first and second protrusion bodies 22, 23 are inclined so that the channel 3 is gradually inclined, but the width W of the channel 3 is unified in every position. By means of such arrangement, when the blade 2 is rotated, the high-pressure area HPA can stably act on the wall 4 of the outer frame of the fan in every position.

Figure 3G:
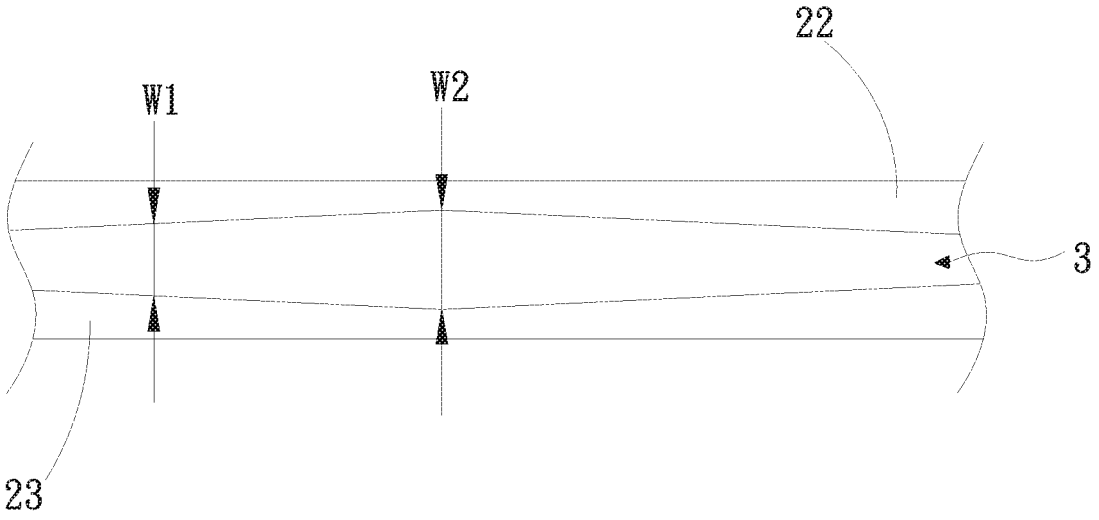
FIG. 3G is a schematic diagram of a seventh modified embodiment of the fan blade of the present invention with one single channel structure.

In FIG. 3G, the first and second protrusion bodies 22, 23 are both tapered toward the middle, whereby the channel 3 is tapered from the middle toward two ends. In this case, the width of the channel 3 is not unified. As shown in the drawing, the width W1 is smaller than the width W2. By means of such arrangement, the range of the high-pressure area HPA is varied with the change of the width of the channel 3.

Figure 3H:
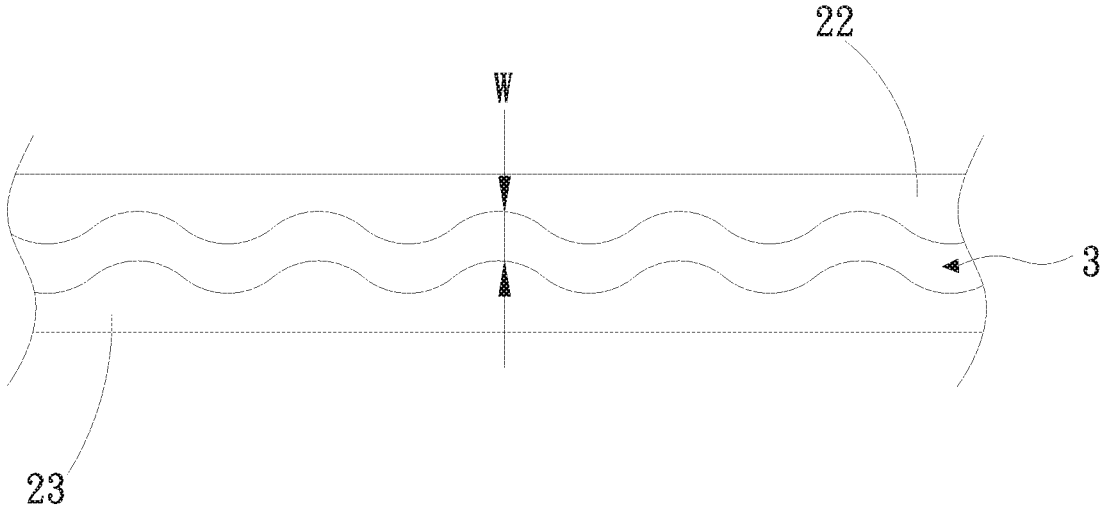
FIG. 3H is a schematic diagram of an eighth modified embodiment of the fan blade of the present invention with one single channel structure.

In FIG. 3H, the first and second protrusion bodies 22, 23 are alternately curved, whereby the channel 3 has a waved form and the width W of the channel 3 is unified in every position. By means of such arrangement, the high-pressure area HPA can act on different positions of the wall 4 of the outer frame of the fan with the change of the channel 3 so as to restrain the generation of the wingtip vortex.

In addition, in the above fan blade units 2 as shown in the drawings, all the channels 3 are relatively positioned in the middle. However, the position of the channel 3 is not limited and the channel 3 can be freely positioned in any other position. For example, the channel 3 can be positioned relatively near the upper surface 213 or the lower surface 214 to provide different restraining effects.

Figure 4A:
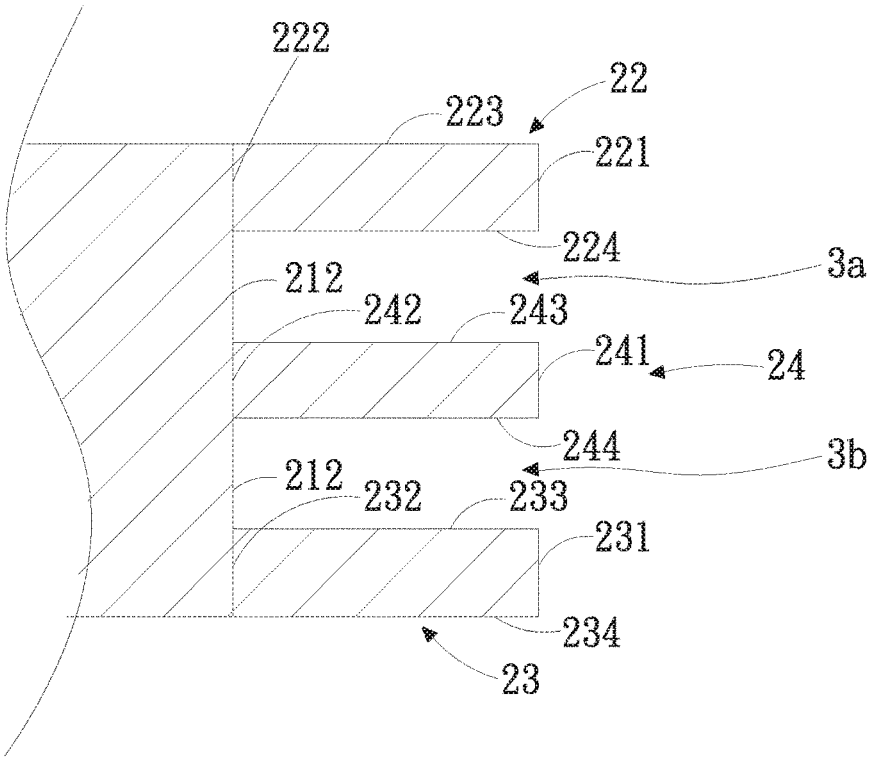
FIG. 4A is a schematic diagram of a first modified embodiment of the fan blade of the present invention with multiple channel structures.
Figure 4B:
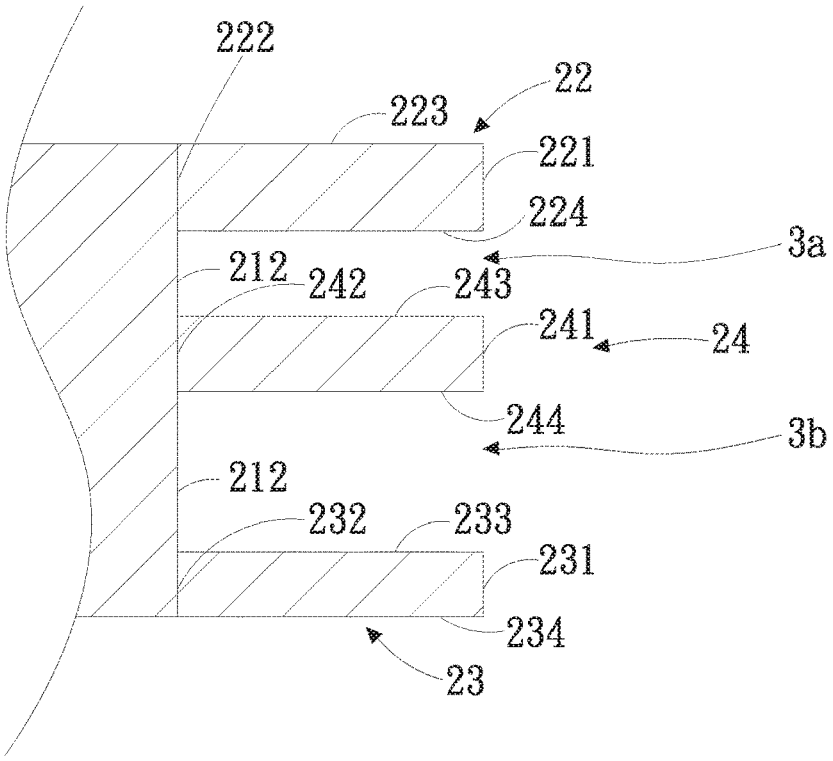
FIG. 4B is a schematic diagram of a second modified embodiment of the fan blade of the present invention with multiple channel structures.

Please now refer to FIGS. 4A and 4B. Also referring to FIGS. 2A to 2D and FIGS. 3A to 3H, the second modified embodiment of the fan blade of the present invention is substantially identical to the first embodiment and the same structure will not be redundantly described hereinafter. The second embodiment is different from the first embodiment in that the end section 212 further has a third protrusion body 24. The third protrusion body 24 has a third top face 241, a third bottom face 242, a third left face 243 and a third right face 244. The third protrusion body 24 is positioned between the first and second protrusion bodies 22, 23.

In this embodiment, the end section 212 has multiple channels. A first channel 3*a* is formed between the first and third protrusion bodies 22, 24. The first right face 224, the end section 212 and the third left face 243 define the first channel 3*a*. The second channel 3*b* is formed between the second protrusion body 23 and the third protrusion body 24. The third right face 244, the end section 212 and the second left face 233 define the second channel 3*b*.

The third protrusion body 24 and the end section 212 can be integrally formed or first respectively formed as separate members and then assembled with each other. In the case that the third protrusion body 24 and the end section 212 are integrally formed, the first, second and third protrusion bodies 22, 23, 24 can be manufactured by means of filling, material removing, plastic injection or slider process. In the case that the third protrusion body 24 and the end section 212 are first respectively formed as separate members and then assembled with each other, the third protrusion body 24 and the end section 212 can be connected with each other by means of insertion, riveting, latching, adhesion, locking, welding or fusion.

Please refer to FIGS. 4A and 4B. In FIG. 4A, the third protrusion body 24 is positioned in the middle so that the width of the first channel 3*a* is equal to the width of the second channel 3*b*. In FIG. 4B, the third protrusion body 24 is not positioned in the middle so that the width of the first channel 3*a* is unequal to the width of the second channel 3*b*. The third protrusion body 24 is added so as to define a first channel 3*a* and a second channel 3*b* to further generate two high-pressure areas. Under such circumstance, it is harder for the airflow on lower side to pass through the gap between the fan blade unit 2 and the wall 4 of the outer frame of the fan to interact with the airflow on upper side to generate wingtip vortex.

Furthermore, the technical features of FIGS. 3A to 311 can be freely applied to the first, second and third protrusion bodies 22, 23, 24 to provide the same effect. This will not be redundantly described hereinafter. The first, second and third protrusion bodies 22, 23, 24 can be made of the same material or different materials. The material is selected from a group consisting of polymer material, metal material and complex material.

In addition, the above embodiment includes three protrusion bodies to define two channels. However, the number of the protrusion bodies is not limited. In practice, a fourth protrusion body or a fifth protrusion body can be further added to form more channels. The added protrusion bodies are all disposed between the first and second protrusion bodies 22, 23. In the case that the number of the channels is more than three, the arrangement of the protrusion bodies can be varied, whereby the channels all have equal widths or unequal widths or partially have equal widths or unequal widths. Accordingly, the channels can be designed according to the use requirement so as to generate different high-pressure areas.

In conclusion, the present invention has the following advantages:

1. The airflow is restrained from creating wingtip vortex.
2. The working performance of the fan is enhanced.
3. The vibration of the end section of the fan blade is reduced.
4. The noise is lowered.
5. The structure of the channel can be easily adjusted and changed.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. An axial flow fan blade unit comprising:

a main body having a root section, an end section, a windward side, a leeward side, a leading edge section, and a trailing edge section the root section having a first end and a second end and being connected with a hub, the end section having a third end and a fourth end and extending in a radial direction away from the hub, the leading edge section being defined between the first end and the third end, the trailing edge section being defined between the second end and the fourth end, the end section defining a continuous blade edge, a first direction, and a second direction, the first direction being a direction extending from the leading edge section to the trailing edge section, the second direction being a direction extending from the windward side to the leeward side;

multiple protrusion bodies extending outwardly in the radial direction at the blade edge; and at least one channel formed in the blade edge between the protrusion bodies, the at least one channel extending along the blade edge in the first direction and between the windward side and the leeward side, the at least one channel being open at the leading edge section and having one end connected with the leading edge section.

2. The fan blade unit as claimed in claim 1, wherein the first and second directions are normal to each other.

3. The fan blade unit as claimed in claim 1, wherein the protrusion bodies are disposed at the end section in parallel to or unparallel to each other.

4. The fan blade unit as claimed in claim 1, wherein the protrusion bodies are defined as a first protrusion body, a second protrusion body and a third protrusion body, the third protrusion body being disposed between the first and second protrusion bodies, the first and third protrusion bodies defining therebetween a first channel, the third and second protrusion bodies defining therebetween a second channel.

5. The fan blade unit as claimed in claim 4, wherein a width of the first channel is equal to or unequal to a width of the second channel.

6. The fan blade unit as claimed in claim 1, wherein the protrusion bodies are integrally formed with each other, or first respectively formed as separate members and then connected to the end sections of the main body the protrusion bodies and the end section being connected with each other by means of insertion, riveting, latching, adhesion, locking, welding or fusion.

7. The fan blade unit as claimed in claim 4, wherein the protrusion bodies are integrally formed with each other, or first respectively formed as separate members and then connected to the end sections of the main body the protrusion bodies and the end section being connected with each other by means of insertion, riveting, latching, adhesion, locking, welding or fusion.

8. The fan blade unit as claimed in claim 1, wherein the protrusion bodies are made of different materials, the different materials selected from a group consisting of polymer materials and metal materials.

9. The fan blade unit as claimed in claim 4, wherein the protrusion bodies are made of different materials, the different materials selected from a group consisting of polymer materials and metal materials.

10. An axial flow fan impeller structure comprising:

a hub; and multiple fan blade units, each fan blade unit including a main body having a root section, an end section, a windward side, a leeward side, a leading edge section, and a trailing edge section, the root section having a first end and a second end and being connected with a hub, the end section having a third end and a fourth end and extending in a radial direction away from the hub, the leading edge section being defined between the first end and the third end, the trailing edge section being defined between the second end and the fourth end, the end section defining a continuous blade edge, a first direction, and a second direction, the first direction being a direction extending from the leading edge section to the trailing edge section, the second direction being a direction extending from the windward side to the leeward side;

multiple protrusion bodies extending outwardly in the radial direction at the blade edge; and at least one channel formed in the blade edge between the protrusion bodies, the at least one channel extending along the blade edge in the first direction and between the windward side and the leeward side, the at least one channel being open at the leading edge section and having one end connected with the leading edge section.

11. The fan impeller structure as claimed in claim 10, wherein the first and second directions are normal to each other.

12. The fan impeller structure as claimed in claim 10, wherein the protrusion bodies are disposed at the end section in parallel to or unparallel to each other.

13. The fan impeller structure as claimed in claim 10, wherein the protrusion bodies are defined as a first protrusion body, a second protrusion body and a third protrusion body, the third protrusion body being disposed between the first and second protrusion bodies, the first and third protrusion bodies defining therebetween a first channel, the third and second protrusion bodies defining therebetween a second channel.

14. The fan impeller structure as claimed in claim 13, wherein a width of the first channel is equal to or unequal to a width of the second channel.

15. The fan impeller structure as claimed in claim 10, wherein the protrusion bodies are integrally formed with the main body or first formed as separate members and then connected to the end sections of the main body the protrusion bodies and the end section being connected with each other by means of insertion, riveting, latching, adhesion, locking, welding or fusion.

16. The fan impeller structure as claimed in claim 13, wherein the protrusion bodies are integrally formed with the main body or first formed as separate members and then connected to the end sections of the main body, the protrusion bodies and the end section being connected with each other by means of insertion, riveting, latching, adhesion, locking, welding or fusion.

17. The fan impeller structure as claimed in claim 10, wherein the protrusion bodies are made of different materials, the different materials selected from a group consisting of polymer materials and metal materials.

18. The fan impeller structure as claimed in claim 13, wherein the protrusion bodies are made of different materials, the different materials selected from a group consisting of polymer materials and metal materials.

* * * * *